US011633012B2

(12) United States Patent
James et al.

(10) Patent No.: US 11,633,012 B2
(45) Date of Patent: Apr. 25, 2023

(54) POST PRODUCTION LASER MODIFICATION OF AN ARTICLE OF FOOTWEAR

(71) Applicant: NIKE, Inc., Beaverton, OR (US)

(72) Inventors: Dervin A. James, Hillsboro, OR (US); Eric S. Schindler, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 6 days.

(21) Appl. No.: 17/332,679

(22) Filed: May 27, 2021

(65) Prior Publication Data

US 2021/0368924 A1 Dec. 2, 2021

Related U.S. Application Data

(60) Provisional application No. 63/032,688, filed on May 31, 2020.

(51) Int. Cl.

| | |
|---|---|
| ***A43B 13/20*** | (2006.01) |
| ***A43B 3/00*** | (2022.01) |
| ***A43B 13/18*** | (2006.01) |
| ***A43B 3/34*** | (2022.01) |

(52) U.S. Cl.

CPC ..... *A43B 13/20* (2013.01); *A43B 3/0078* (2013.01); *A43B 3/34* (2022.01); *A43B 13/186* (2013.01); *A43B 13/188* (2013.01)

(58) Field of Classification Search

CPC ... A43B 13/20; A43B 13/0078; A43B 13/186; A43B 13/188; A43B 13/16; A43B 13/189; A43B 3/0078; A43B 21/265

See application file for complete search history.

(56) References Cited

U.S. PATENT DOCUMENTS

| | | | | |
|---|---|---|---|---|
| 5,393,372 | A * | 2/1995 | Ammon | A43B 13/00 216/33 |
| 9,854,870 | B2 * | 1/2018 | Hensley | A43B 13/12 |
| 9,931,804 | B2 * | 4/2018 | Le | B29D 35/142 |
| 10,149,513 | B1 * | 12/2018 | Eldem | A43B 13/188 |
| 2007/0162176 | A1 * | 7/2007 | Peyser | A41D 27/08 700/138 |
| 2014/0093707 | A1 * | 4/2014 | Kaufmann | B44C 1/105 156/230 |
| 2015/0265000 | A1 | 9/2015 | Marshall et al. | |
| 2015/0351499 | A1 * | 12/2015 | James | D06H 1/003 427/256 |
| 2016/0295963 | A1 * | 10/2016 | Chang | A43B 1/0072 |
| 2016/0295964 | A1 * | 10/2016 | Hensley | B32B 27/08 |
| 2016/0295965 | A1 * | 10/2016 | Hensley | A43B 13/20 |
| 2016/0295966 | A1 * | 10/2016 | Hensley | A43B 23/24 |
| 2016/0366959 | A1 * | 12/2016 | Hull | A41D 19/01517 |

(Continued)

FOREIGN PATENT DOCUMENTS

WO 2020046558 A1 3/2020

*Primary Examiner* — Bao-Thieu L Nguyen
(74) *Attorney, Agent, or Firm* — Quinn IP Law

(57) ABSTRACT

A sole assembly for an article of footwear includes a midsole that is formed from at least a bladder and foam midsole component. The midsole has a ground facing surface and a sidewall, and the bladder meets the foam midsole at a component boundary on the sidewall. An etching extends into both the foam midsole and the bladder. The etched channel has a depth into the sidewall of between about 2 μm and about 1000 μm and continuously extends across the component boundary.

17 Claims, 5 Drawing Sheets

(56) References Cited

U.S. PATENT DOCUMENTS

| | | | | |
|---|---|---|---|---|
| 2017/0020232 | A1* | 1/2017 | Bello Decurnex | A43B 23/024 |
| 2018/0289098 | A1* | 10/2018 | Downing | B23K 26/354 |
| 2019/0014835 | A1* | 1/2019 | Hull | A41D 19/01517 |
| 2020/0113283 | A1* | 4/2020 | Hensley | B29D 35/148 |
| 2021/0120913 | A1* | 4/2021 | Blanche | A43B 13/187 |

* cited by examiner

POST PRODUCTION LASER MODIFICATION OF AN ARTICLE OF FOOTWEAR

CROSS REFERENCE TO RELATED APPLICATIONS

The present application claims the benefit of priority from U.S. Provisional Patent Application No. 63/032,688, filed May 31, 2020, which is incorporated by reference in its entirety.

TECHNICAL FIELD

The present teachings generally relate to a manner of cosmetically modifying an article of footwear using a laser etching device.

BACKGROUND

Footwear typically includes a sole configured to be located under a wearer's foot to space the foot away from the ground or floor surface. Soles can be designed to provide a desired level of cushioning. A sole may be an assembly that includes a midsole and an outsole. Athletic footwear in particular sometimes utilizes a polyurethane or ethylene-vinyl acetate foam or other resilient materials in the sole to provide cushioning. In some configurations, the sole may further include one or more fluid filled chambers to alter the cushioning performance.

SUMMARY

In one configuration, sole assembly for an article of footwear includes a midsole that is formed from at least a bladder and foam midsole component. The midsole has a ground facing surface and a sidewall, and the bladder meets the foam midsole at a component boundary on the sidewall. An etching extends into both the foam midsole and the bladder. The etched channel has a depth into the sidewall of between about 2 μm and about 1000 μm and continuously extends across the component boundary.

Further, in some embodiments, an article of footwear includes an upper defining an internal cavity operative to receive a foot of the wearer, and a sole structure coupled to the upper. The sole structure includes a ground contacting surface opposite the upper, a midsole formed from a thermoplastic polymeric foam, and a fluid-filled bladder. The midsole has a foam sidewall that defines a first portion of an outer perimeter of the sole structure. The foam sidewall extends upward at an angle relative to the ground contacting surface, and The fluid-filled bladder has a bladder sidewall that defines a second portion of the outer perimeter of the sole structure. The bladder sidewall directly abuts the foam sidewall at a component boundary. Finally, an etching extends continuously from the foam sidewall to the bladder sidewall across the component boundary.

In further aspects of the present disclosure, the etching may form a graphical design or logo, and may be created from a visual image that is received via a networked computing system. In some embodiments, the etching may at least partially expose or else make visible interior material layers, which may be differently colored from an outer-most material layer. The etching may comprise a texture that can be useful to individuals with visual impairments in differentiating left from right shoes within a coordinated pair of shoes. Further, the etching may provide a unique identifier from which the authenticity of the article of footwear may be determined. Other aspects and advantages of the present design are provided below, including associated methods for producing the etching.

DETAILED DESCRIPTION

Figure 1:
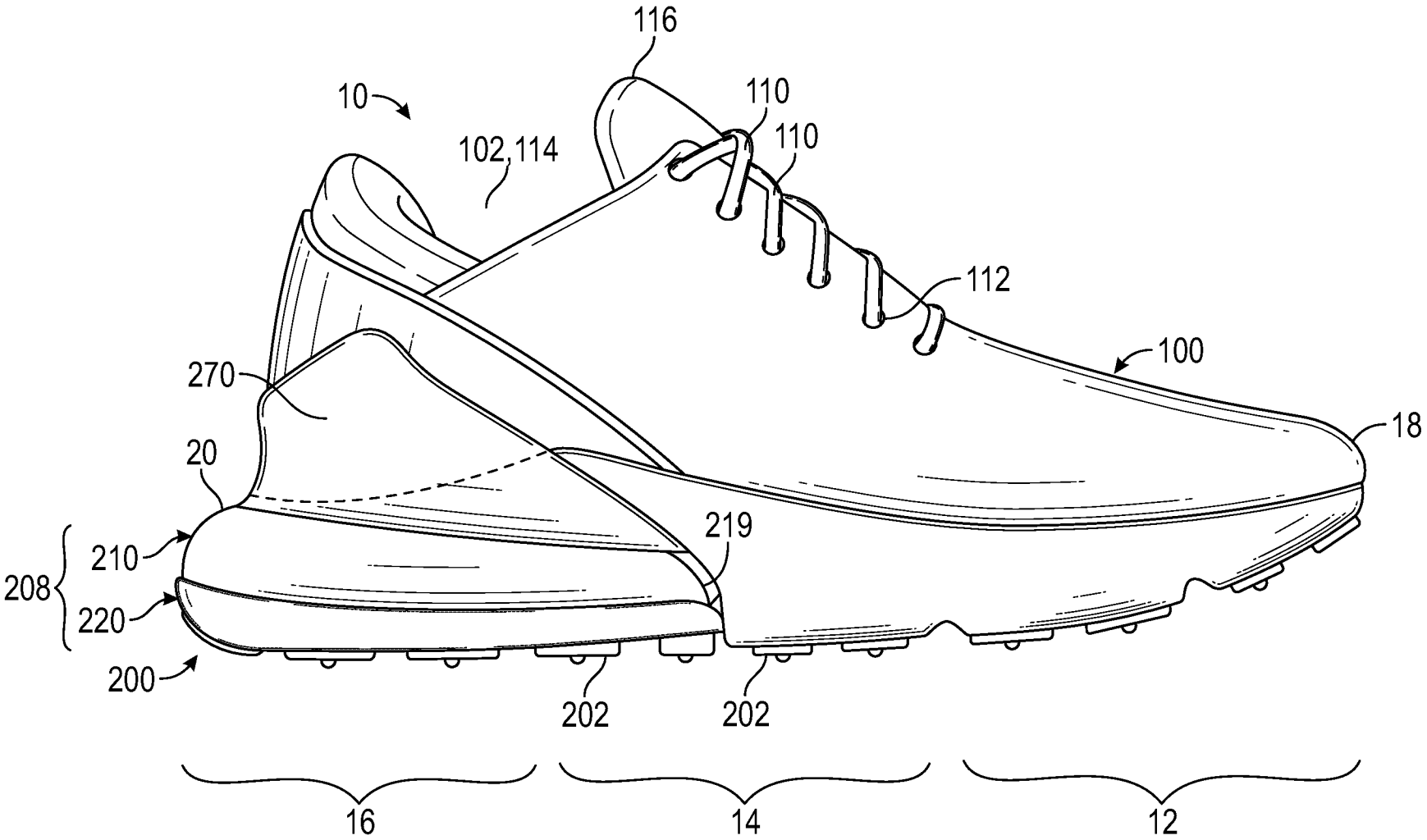
FIG. 1 is a side perspective view of an article of footwear in accordance with principles of the present disclosure.

The present disclosure generally relates to a manner of altering the visual and/or tactile characteristics of an article of footwear after the article has been fully assembled. In doing so, graphics or tactile textures may be extended continuously across multiple adjacent components, which my otherwise be extremely difficult to properly execute if the graphics or textures were applied prior to assembly.

Example configurations will now be described more fully with reference to the accompanying drawings. These configurations are provided so that this disclosure will be thorough and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Figure 2:
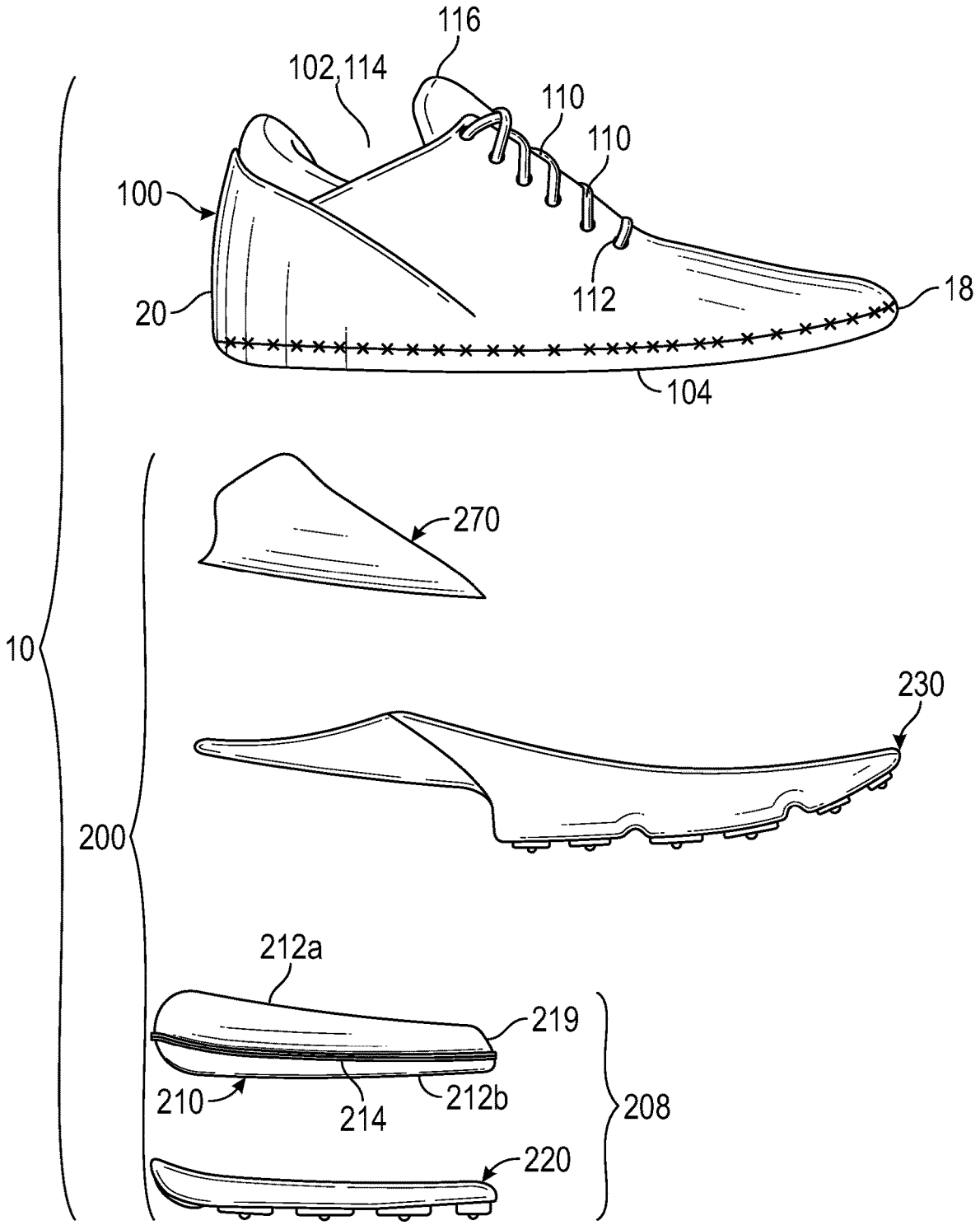
FIG. 2 is an exploded view of the article of footwear of FIG. 1, showing an article of footwear having an upper and a sole structure arranged in a layered configuration.

Referring to FIGS. 1-2, an article of footwear 10 includes an upper 100 and sole structure 200. The article of footwear 10 may be divided into one or more regions. The regions may include a forefoot region 12, a mid-foot region 14, and a heel region 16. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis of the footwear 10 generally extends along a length of the footwear 10 from the anterior end 18 to the posterior end 20, and generally divides the footwear 10 into a lateral side and a medial side. Accordingly, the lateral side and the medial side respectively correspond with opposite sides of the footwear 10 and extend through the regions 12, 14, 16.

The upper 100 includes interior surfaces that define an interior void 102 configured to receive and secure a foot for support on sole structure 200. The upper 100 may be formed from one or more materials that are stitched or adhesively bonded together to form the interior void 102. Suitable materials of the upper may include, but are not limited to, mesh, textiles, foam, leather, and synthetic leather. The materials may be selected and located to impart properties of durability, air-permeability, wear-resistance, flexibility, and comfort.

With reference to FIG. 2, in some examples the upper 100 includes a strobel 104 having a bottom surface opposing the sole structure 200 and an opposing top surface defining a footbed of the interior void 102. Stitching or adhesives may secure the strobel to the upper 100. The footbed may be contoured to conform to a profile of the bottom surface (e.g., plantar) of the foot. Optionally, the upper 100 may also incorporate additional layers such as an insole or sockliner that may be disposed upon the strobel 104 and reside within the interior void 102 of the upper 100 to receive a plantar surface of the foot to enhance the comfort of the article of footwear 10. An ankle opening 114 in the heel region 16 may provide access to the interior void 102. For example, the ankle opening 114 may receive a foot to secure the foot within the void 102 and to facilitate entry and removal of the foot from and to the interior void 102.

In some examples, one or more fasteners 110 extend along the upper 100 to adjust a fit of the upper 100 around the foot and to accommodate entry and removal of the foot therefrom. The upper 100 may include apertures 112 such as eyelets and/or other engagement features such as fabric or mesh loops that receive the fasteners 110. The fasteners 110 may include laces, straps, cords, hook-and-loop, or any other suitable type of fastener. The upper 100 may include a tongue portion 116 that extends between the interior void 102 and the fasteners.

With continued reference to FIGS. 1-2, the sole structure 200 includes a cushioning component 208 that defines a portion of the outer periphery of the sole structure 200 within the heel region 16. The cushioning component 208 may include a fluid-filled bladder 210 and an outsole portion 220. In some configurations, the outsole portion 220 may be integrally coupled with the fluid-filled bladder 210, such as via an overmolding process, or else by integrally molding the outsole portion 220 when forming a wall of the bladder 210. The outsole portion 220 extends along a ground-facing side of the fluid-filled bladder 210 and may define a first portion of a ground-engaging surface 202 of the sole structure 200.

The sole structure 200 further includes a forward midsole component 230 in the forefoot region 12 and the mid-foot region 14. The forward midsole component 230 may be formed from an energy absorbing material such as, for example, a polymeric foam. Forming the forward midsole component 230 from an energy-absorbing material such as a polymeric foam allows the forward midsole component 230 to attenuate ground-reaction forces caused by movement of the article of footwear 10 over ground during use.

With reference to FIG. 2, the fluid-filled bladder 210 may be formed from a plurality of polymeric sheets (e.g., first and second polymeric sheets 212*a*, 212*b*) that are fused together at a peripheral flange or seam 214 to define an internal volume between the respective sheets 212*a*, 212*b*. This internal volume is adapted to receive a pressurized fluid (e.g. air), which may provide a cushioning quality to the sole structure. In some embodiments, the seam 214 may extend around some or all of the periphery of the fluid-filled bladder 210, though may preferably be concealed by the outsole portion 220. Although the seam 214 is illustrated as forming a relatively pronounced flange protruding outwardly from the fluid-filled bladder 210, in some embodiments, the seam 214 may be a flat seam such that the upper polymeric sheet 212*a* and the lower polymeric sheet 212*b* are substantially continuous with each other. In some embodiments, additional polymeric sheets may be provided between the first and second polymeric sheets 212*a*, 212*b* to define one or more additional volumes within the fluid-filled bladder 210.

The first and second polymeric sheets 212*a*, 212*b* may each be formed from one or more layers of a substantially transparent, thermoplastic material, such as a thermoplastic polyurethane (TPU). Examples of other suitable polymeric materials that may be used to form the fluid-filled bladder 210 include thermoplastic polyurethane, polyester, polyester polyurethane, and polyether polyurethane. Moreover, each of the polymeric sheets 212*a*, 212*b* forming the fluid-filled bladder 210 can include layers of different materials. In one embodiment, the polymeric sheets 212*a*, 212*b* may be formed from a plurality alternating thin films comprising one or more thermoplastic polyurethane (TPU) layers and one or more barrier layers comprising a copolymer of ethylene and vinyl alcohol (EVOH). In use, the EVOH layers may be configured such that they are impermeable to the pressurized fluid contained therein. Such constructions are further disclosed in U.S. Pat. No. 6,082,025 to Bonk et al., which is incorporated by reference in its entirety.

In some embodiments, the polymeric sheets 212*a*, 212*b* may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The polymeric sheets 212*a*, 212*b* of the fluid-filled bladder 210 may also be flexible microlayer membranes that include alternating layers of a gas barrier material and an elastomeric material, as disclosed in U.S. Pat. Nos. 6,082,025 and 6,127,026 to Bonk et al. which are incorporated by reference in their entireties. Additional suitable materials for the fluid-filled bladder 210 are disclosed in U.S. Pat. Nos. 4,183,156 and 4,219,945 to Rudy, which are incorporated by reference in their entireties. Further suitable materials for the fluid-filled bladder 210 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties.

In selecting materials for the fluid-filled bladder 210, engineering properties such as tensile strength, stretch properties, fatigue characteristics, dynamic modulus, and loss tangent can be considered. The thicknesses of polymeric sheets 212*a*, 212*b* used to form the fluid-filled bladder 210 can be selected to provide these characteristics. The fluid-filled bladder 210 is resilient and provides cushioning and flexibility that can be tuned such as by selecting a level of pressurization. Optionally, tensile members and/or reinforcing structures can be integrated with the fluid-filled bladder 210 to provide desired responsiveness, such as disclosed in U.S. Pat. No. 4,906,502 to Rudy et al., and U.S. Pat. No. 8,061,060 to Swigart et al., which are incorporated by reference in their entireties.

In some implementations, the outsole portion 220 extends over a portion of the bladder 210 to provide increased durability and resiliency for the bladder 210. Accordingly, the outsole portion 220 may be formed of a different material than the bladder 210, and includes at least one of a different thickness, a different hardness, and a different abrasion resistance than the second/lower polymeric sheet 212*b*. In some examples, the outsole portion 220 may be formed integrally with the second polymeric sheet 212*b* of the bladder 210 using an over-molding process. In other examples the outsole portion 220 may be formed separately from the second polymeric sheet 212*b* and may be adhesively bonded to the second barrier layer 212*b* through a subsequent process.

With continued reference to FIGS. 1-2, the fluid-filled bladder may be continuously exposed along an outer periphery of the heel region 16 from a distal end 219 on the lateral side to a similar distal end on the medial side. For example, the first barrier layer 212*a* may be continuously exposed along the outer periphery of the sole structure 200 between the upper 100 and the outsole portion 220, such that the transparent first polymeric sheet 212*a* is exposed around the periphery of the heel region 16.

The sole structure 200 may further include a heel counter 270 that may be formed of the same transparent TPU material as the first polymeric sheet 212*a* and may further extend over a portion of the forward midsole component 230. As shown, the heel counter 270 extends from the first distal end 219 of the bladder 210, around the posterior end 20, and to the distal end of the bladder 210 on the opposite side of the sole structure 200

In general, the fluid-filled bladder 210 and the forward midsole component 230 may cooperate to define at least a portion of the overall midsole of the article of footwear. The midsole generally has an outward facing midsole sidewall that is at least partially formed from a fluid-filled bladder sidewall and a forward midsole component sidewall. The midsole sidewall may generally extend upward from the ground-engaging surface 202 toward the upper and may form at least a portion of the overall side profile of the article of footwear 10.

Figure 3:
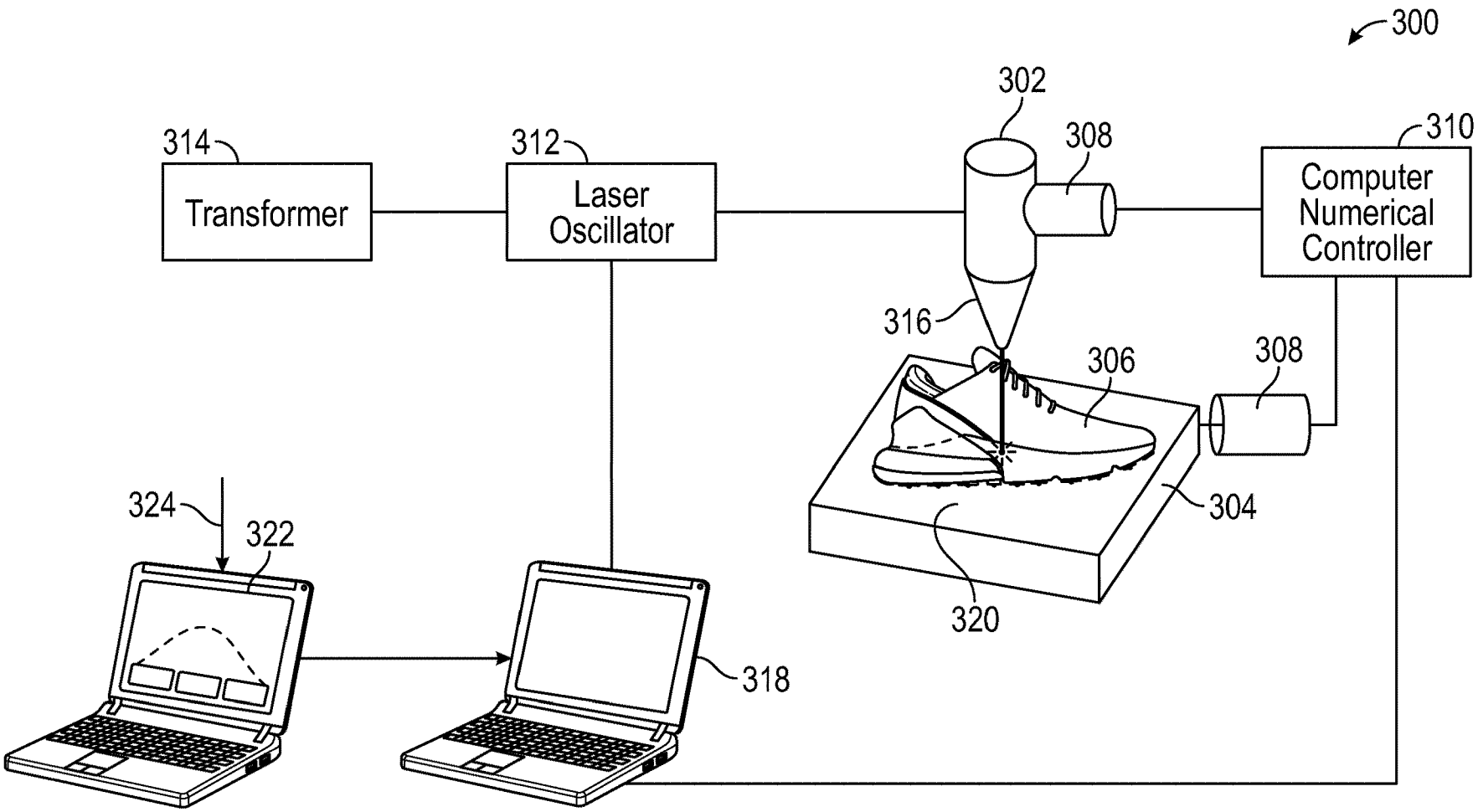
FIG. 3 is a schematic diagram of a laser etching system

In one embodiment, an article of footwear 10, and in particular, the sole structure 200 of the article of footwear may have its visual and/or tactile appearance customized through the use of an etching process. In particular, a laser etching system 300, such as shown in FIG. 3, may be used to scribe one or more designs into the midsole sidewall, where the designs may extend across one or both of the fluid-filled bladder sidewall and the forward midsole component sidewall. The system 300 may generally include a laser head 302, a workpiece holder 304 configured to hold and/or move a workpiece 306, a movement system 308 configured to provide motion between the laser head 302 and the workpiece, and a computer numerical controller 310 configured to control the movement between the laser head 302 and the workpiece. The laser head 302 may emit an intense beam of light at a particular wavelength, and may be driven by a laser oscillator 312, which is in turn powered by a transformer 314.

The laser etching system 300 may include any suitable type of laser cutting machine for cutting away sole material. For example, the laser etching system 300 may include a pulse fiber laser, continuous wave carbon dioxide laser, ultraviolet solid state laser, yttrium lithium fluoride laser, or excimer (exciplex) laser cutting machine, e.g., the 5-axis computer numerical controlled laser cutting machine ML1515VZ20 that is manufactured by Mitsubishi Corporation. In another example, Sumitomo Heavy Industries, Ltd. makes laser cutting machines, such as the KrF excimer laser INDEX-848K having a wavelength of 248 nm.

The wavelength of the laser light may vary depending upon the nature of material to be cut and the desired effect. In some embodiments, the wavelength may be in the ultraviolet portion of the spectrum, i.e., from about 10 nm to about 400 nm. In other embodiments, a specific portion of the ultraviolet spectrum may be selected, such as from about 200 nm to about 300 nm. For example, for many polymers, 248 nm light may be effective for cutting/etching. In other embodiments, other portions of the electromagnetic spectrum may be selected for the laser. Infrared light may also be selected, e.g., carbon dioxide lasers in the 940 nm-1064 nm wavelength range may be desirable for certain materials/effects. In other embodiments, lasers operating at 355 nm, 532 nm, and 1064 nm may be desirable. When used with thermoplastics, IR (e.g. >700 nm) lasers may tend to thermally transform/melt the polymer (i.e., a "hot" process), while UV lasers (e.g., <400 nm) may break molecular bonds at the surface layer in a "cold" photo-ablation process that can produce features with smoother edges. Similarly to the selection of wavelength, the power of the laser and/or the duration of any laser pulses or exposure to laser beams may be selected depending upon such factors as the wavelength, the power source, the type of material desired to be cut/etched, and the type of cutting/etching effect desired.

The laser head 302 may be connected to the laser oscillator 312 and may be configured to focus the laser produced by the laser oscillator 312. The laser head 302 may include a laser nozzle 316 disposed on the bottom of the laser head 302. The laser nozzle 316 may be configured to further focus the laser and emit a laser beam, and may be adjustable to increase and/or decrease the focus of the laser beam. In some embodiments, the laser nozzle 316 may be adjusted by a local processing device 318. The local processing device 318 is discussed in more detail below. The type of laser head 302 and/or laser nozzle 316 may be selected based on a variety of factors. For example, the type of laser head and laser nozzle may be selected based on the type of the laser cutting machine used and/or the desired depth and shape of the etching pattern.

A workpiece holder 304 may include any suitable type of holder that is operative to hold an article of footwear. For example, as shown in FIG. 3 the workpiece holder 304 may include a workpiece table 320. In other embodiments, the workpiece holder 304 may include a last upon which the article of footwear is mounted.

The laser etching system 300 of FIG. 3 may include a movement system 308 providing motion between the laser head 302 and the workpiece, e.g., the ML1515VZ20 from Mitsubishi Corporation as noted above. In one configuration, the laser etching system 300 may include a 5-axis cutting machine configured to move the laser head 302 in three directions and the workpiece in two directions. In some embodiments, the laser etching system 300 may include a 5-axis cutting machine configured to move the laser head 302 in two directions and the workpiece in three directions. The laser etching system 300 may alternatively include a 6-axis cutting machine configured to move the laser head 302 in three directions and the workpiece in three directions. Providing multiple directions of movement between the laser head 302 and the workpiece holder 304 may provide many etching pattern possibilities.

When used to etch a visual pattern in the sole structure 200, the laser beam emitted from the laser head 302 may be adjusted to leave the surface of the sole structure 200 smooth after cutting, though may alter a visual appearance of the polymer. In some embodiments, the laser beam emitted from the laser head 302 may be adjusted to leave marks in the wake of the laser beam. The marks resulting from laser cutting may be so subtle and uniform that the roughness of the resulting surface of the sole structure 200 may be extremely low or relatively unchanged from a pre-etched state. In some embodiments, the laser etching system 300 of FIG. 3 may be used to cut fine lines and/or other repeated patterns that may add texture to the surface of the sole structure 200.

As discussed above, the laser etching system 300 may include a computer numerical controller 310 configured to control the movement between the laser head 302 and the workpiece. For example, as mentioned above, Mitsubishi Corporation makes 5-axis computer numerical controlled laser cutting machines, such as the ML1515VZ20. In some embodiments, the computer numerical controller 310 may be configured to control the focus of the laser beam emitted from the laser head 302. The computer numerical controller 310 may include any suitable type of computer numerical controller. The type of computer numerical controller may be selected based on a variety of factors. For instance, the type of computer numerical controller may be selected based on the type of laser head and/or type of workpiece table used.

The laser etching system 300 of FIG. 3 may include a local processing device 318 operative to control the laser head 302 and/or the computer numerical controller 310. In some embodiments, the local processing device includes a local user interface that is operative to configure the system 300. The local processing device 318 may include one or more dedicated processors, or one or more computing devices in local communication with the computer numerical controller 310. For example, in some embodiments, the local processing device 318 may include a desktop or laptop computer, a tablet computer, or a suitable portable computing device in wired or direct wireless communication with the computer numerical controller 310.

In some embodiments, the local processing device 318 may be in communication with one or more networked user interfaces 322 over a digital computer network, local area network, wide area network, or through point-to-point RF communications such as using a BLUETOOTH protocol. The networked user interface 322 may be displayed or provided on any suitable portable computing device, such as a smartphone, tablet, laptop, or the like and may enable a user to provide one or more designs 324 that are desired to be etched into the sole structure 200. In some embodiments, the networked user interface 322 may include a dedicated application operating on the user's device or may include an internet-based web application that is viewable through a suitable internet browser.

As shown in FIG. 3, a user may access the networked user interface 322 via a display screen or other human-machine interface device to respond to a set of user prompts. For instance, the display screen may be a touch screen and the user prompts may be one or more icons and/or text-based prompts requesting entry of a desired surface feature or design, such as a customized depth, pattern, or effect that may be etched into the sole structure 200. Alternatively, the user prompts may request entry of a desired logo on the outer surface of the sole structure 200, with the term "logo" as used herein referring to any image, letters, characters, or the like which would effectively form a custom watermark or etched image.

As noted above, in one embodiment, the article of footwear 10, and in particular, the sole structure 200 of the article of footwear may have its visual appearance customized via the laser etching system 300. In particular, the laser etching system 300 may be configured to controllably apply laser energy to an outer surface of the article of footwear 10 for the purpose altering a visual characteristic of the material used to form the article and/or altering a physical characteristic of the article itself.

Figure 4:
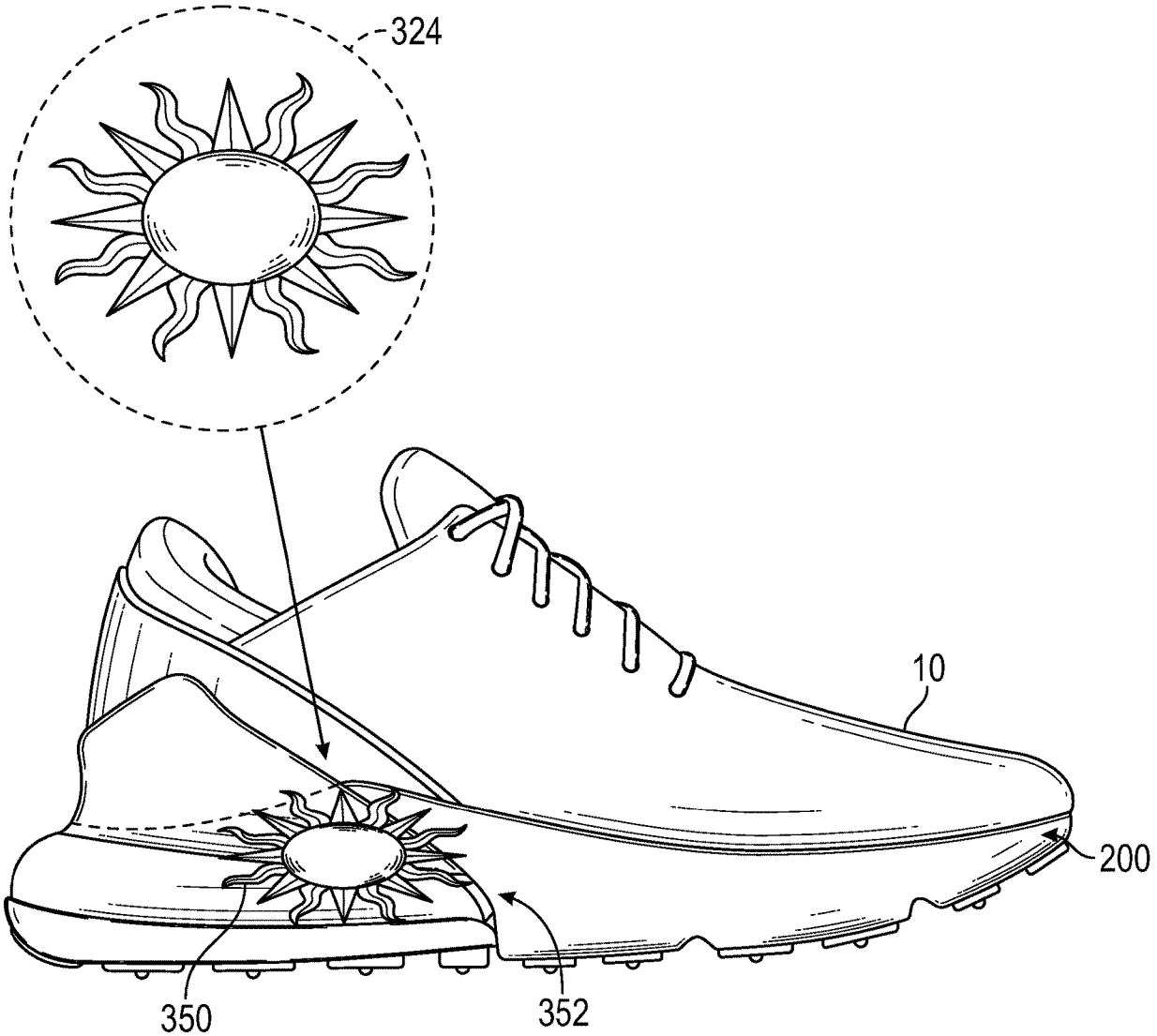
FIG. 4 is a schematic diagram of a design being applied to a sidewall of an article of footwear.

FIG. 4 schematically illustrates one embodiment of an article of footwear 10 having an etched pattern 350 imprinted into an outer surface 352. As generally illustrated, the etched pattern 350 may extend continuously across multiple components without interruption. In one particular embodiment, this continuous aspect of the etched pattern 350 may be formed by controlling the movement system 308, computer numerical controller 310 and/or workpiece holder 304 such that the laser beam emanating from the laser head 302 is approximately orthogonal to the outer surface 352 at the point where the beam impacts the outer surface.

Figure 5:
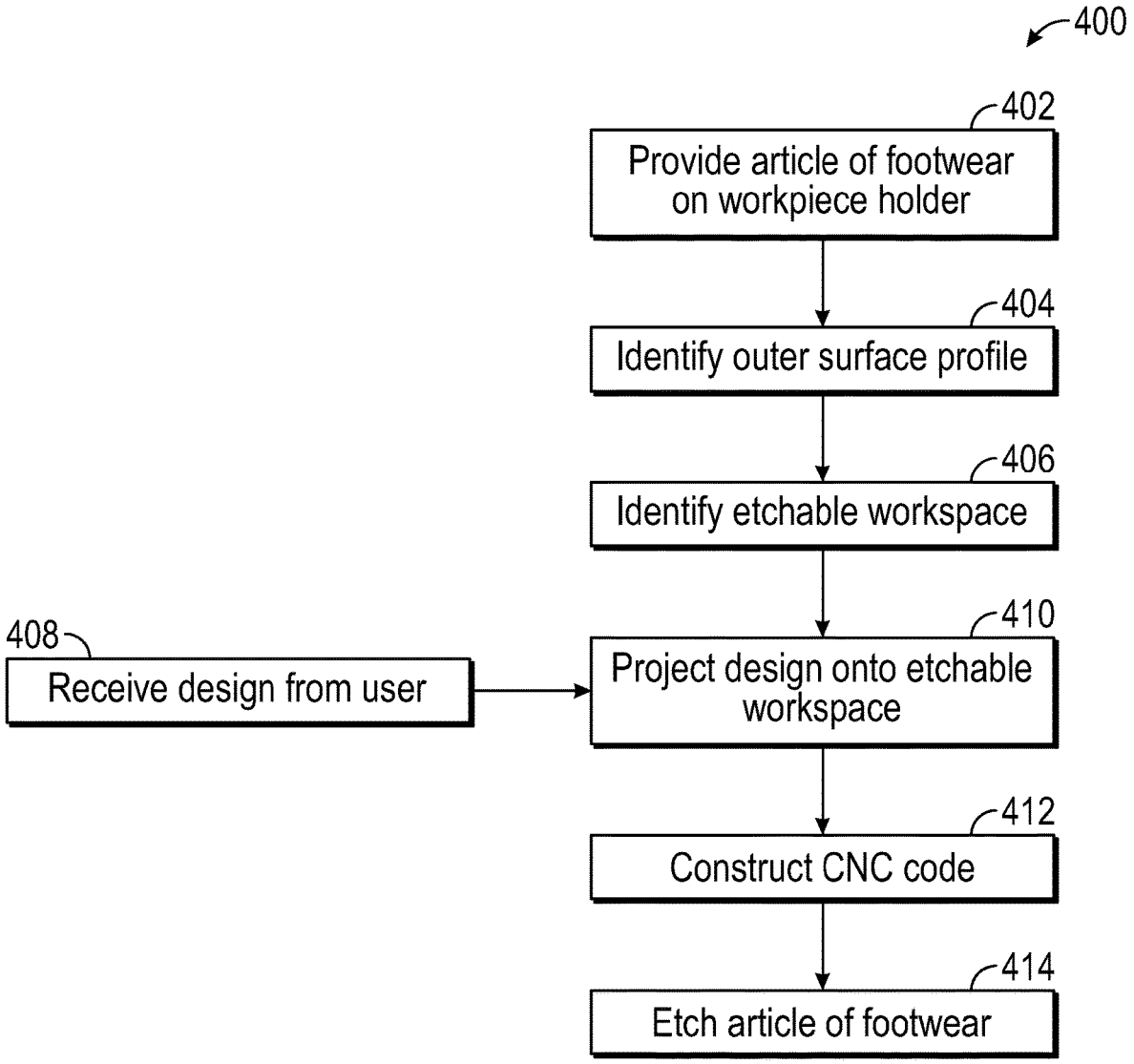
FIG. 5 is a schematic flow diagram of a method of laser etching an article of footwear

FIG. 5 schematically illustrates an embodiment of a method 400 for laser etching an article of footwear. As shown, the method 400 may include providing (or receiving) an article of footwear 10 on a workpiece holder 304 (at 402) and identifying the silhouette or outer surface profile of the article of footwear (at 404), followed by identifying an etchable workspace on the outer surface of the article (at 406). Identifying the silhouette may occur either manually, such as by receiving, from the user interface, an indication of the model and size of the article of footwear, or automatically, such as by scanning the outer surface of the article, for example, with a laser. In one embodiment, the identified etchable workspace extends continuously over multiple components, such as a polymeric foam midsole (e.g., the forward midsole component 230 shown in FIGS.

1-2), a polymeric fluid filled chamber (e.g., fluid-filled chamber 210 shown in FIGS. 1-2), and/or a heel counter (e.g., the heel counter 270 shown in FIGS. 1-2).

The method 400 further includes receiving a design (at 408) from a user via the local processing device 318 and/or the networked user interface 322. In one configuration, the design may comprise a repeating pattern of discrete graphical primitives, such as repeating check pattern or a repeating herringbone design. In another configuration, the design may comprise a more complex graphic, such as a logo, picture, or other creative work.

Following receipt of the design at 408, the local processing device 318 may apply/project the design onto the etchable workspace (at 410), and then construct a series of numerical codes (at 412) that may be used to instruct the movement system 308 and/or computer numerical controller 310 to move the laser head 302 such that the laser beam traces the design onto the article (at 414). In one embodiment, the local processing device 318 may utilize the dimensional geometry of the outer surface of the article to construct numerical codes that maintain the laser beam in an approximately orthogonal orientation to the surface on which it's shining. Following the creation of the numerical codes, the local processing device may instruct the movement system 308 and/or computer numerical controller 310 to move the laser head 302 while modulating the laser oscillator 312 and/or power of the laser to etch the prescribed design into the article.

Applying the design in this manner may result in a completed article with at least one etched line, formed by the laser, that extends continuously across a boundary between two components. In one embodiment, the laser may cut or locally melt the outer surface of the one or more components to result in a channel having a depth, measured from one or more directly adjacent land areas, of between about 2 μm and about 1000 μm, or between about 2 μm and about 500 μm, or between about 2 μm and about 125 μm, or even between about 2 μm and about 25 μm.

In one embodiment, at least one of the midsole (e.g., the forward midsole component 230 shown in FIGS. 1-2), polymeric fluid filled chamber (e.g., fluid-filled chamber 210 shown in FIGS. 1-2), and/or heel counter (e.g., the heel counter 270 shown in FIGS. 1-2) may have an outer skin or outer material construction that is comprised of a plurality of layers. One or more of the layers may have a substantially constant thickness, and at least two of the layers may be formed from materials having different pigmentation. In such an embodiment, the depth of the laser etching may be greater than 75% of the thickness of the outer-most layer such that the second layer (i.e., the layer immediately below the outer-most layer) may be at least partially visible through the etched channel and/or remaining material of the outer layer. In one embodiment, the depth of the laser etching may be greater than or equal to the thickness of the outer-most layer such that the second layer is at least partially exposed within the channel formed via the etching. In some configurations, the second layer may be a different color than the outer-most layer, and further may only be visible through the etched channel.

In another embodiment, the etching process may alter one or more of the pigments of the outer surface of the sole structure 200 or may alter the light transmissibility of the polymer, such as in a barrier layer 212*a* of the fluid-filled chamber 210. The alteration in the pigmentation and/or transmissibility of the polymer may occur, for example, by altering the polymer chain structure, or by initiating a hyperlocalized chemical reaction that results in a visible change.

The etchable workspace may include various portions of the article of footwear, including the toe bumper, sidewall of the sole structure, ground facing surface, heel counter, fluid filled chamber, and/or upper.

In some configurations, the processes and systems described herein may be used to apply a texture to an outer surface of the article of footwear and across multiple discrete components. This texture may enable non-visual differentiation between a right shoe and a left shoe, which may be beneficial for individuals with visual impairments. For example, in one configuration, the texture may be applied to only one shoe in a respective pair of shoes. In another configuration, similar textures may be applied to each shoe, however, the texture may only be applied to one of the lateral or medial side of each article (though consistent between the two—i.e., both lateral or both medial). In yet another configuration, a first texture may be applied to a first article in the respective pair while a second texture, differentiable from the first texture, may be applied to the second article in the pair. In these embodiments, the applied texture may generally include a debossed or etched surface profile that has sufficient roughness or surface geometry to be perceivable and identifiable by human touch.

In yet another configuration, the applied pattern or logo may contain enough unique content to authenticate the article of footwear as being genuine and not a counterfeit. In particular, by etching across multiple components of the sole and/or upper, the ability to produce a convincing counterfeit may be further complicated. In one configuration, the authenticating or identifying mark may be digitally encoded within a broader texture or visual design such as described in U.S. patent application Ser. No. 17/116,527, which is incorporated by reference in its entirety and for all that it discloses.

While the best modes for carrying out the invention have been described in detail, those familiar with the art to which this invention relates will recognize various alternative designs and embodiments for practicing the invention within the scope of the appended claims. It is intended that all matter contained in the above description or shown in the accompanying drawings shall be interpreted as illustrative only and not as limiting.

The invention claimed is:

1. A sole assembly for an article of footwear comprising:

a midsole comprising a bladder and a directly abutting foam midsole component, wherein the bladder defines a fluid-filled chamber, the midsole having a ground facing surface and a sidewall, the foam midsole component forms a first visible portion of the sidewall and wherein the bladder forms a second visible portion of the sidewall, and wherein the bladder meets the foam midsole component on the sidewall to define a component boundary;

an etched channel extending into both the foam midsole component and the bladder, the etched channel having a depth into the sidewall of between about 2 μm and about 1000 μm, and wherein the etched channel continuously extends across the component boundary.

2. The sole structure of claim 1, wherein the etched channel forms a design or logo.

3. The sole structure of claim 1, wherein at least one of the bladder or the foam midsole component includes a plurality of material layers with an outer-most layer forming an external surface of the midsole; and wherein the depth is greater than 75% of a thickness of the outer-most layer.

4. The sole structure of claim 3, wherein the plurality of material layers comprises a second layer directly abutting the outer-most layer; and wherein the second layer is at least partially visible through the etched channel.

5. The sole structure of claim 4, wherein the second layer is a different color than the outer-most layer, and wherein the second layer is only visible through the etched channel.

6. The sole structure of claim 1, wherein the bladder has a convex surface profile relative to the sole structure, and wherein the etched channel is formed at least in part into the convex surface profile.

7. An article of footwear having a forefoot portion, a midfoot portion, and a heel portion, the article of footwear comprising:

an upper defining an internal cavity operative to receive a foot of the wearer;

a sole structure coupled to the upper, the sole structure comprising:

a ground contacting surface opposite the upper;

a midsole formed from a thermoplastic polymeric foam;

a fluid-filled bladder; and wherein the midsole has a foam sidewall that defines a first portion of an outer perimeter of the sole structure, the foam sidewall extending upward at an angle relative to the ground contacting surface;

wherein the fluid-filled bladder has a bladder sidewall that defines a second portion of the outer perimeter of the sole structure, the bladder sidewall directly abutting the foam sidewall at a component boundary; and an etching extending into the foam sidewall and the directly abutting bladder sidewall such that the etching is continuous across the component boundary.

8. The article of footwear of claim 7, wherein the etching comprises a channel having a channel depth relative to the adjoining outer perimeter of between about 2 μm and about 1000 μm.

9. The article of footwear of claim 7, wherein the fluid-filled bladder is provided in the heel portion of the article of footwear.

10. The article of footwear of claim 9, wherein the bladder sidewall is convex in a plane orthogonal to the ground contacting surface.

11. The article of footwear of claim 7, wherein the etching forms a design or logo.

12. The article of footwear of claim 7, wherein at least one of the fluid-filled bladder or the foam midsole includes a plurality of material layers with an outer-most layer forming an external surface of the sole structure; and wherein the etching has a depth that is greater than 75% of a thickness of the outer-most layer.

13. The article of footwear of claim 12, wherein the plurality of material layers comprises a second layer directly abutting the outer-most layer; and wherein the second layer is at least partially visible through the etching.

14. The sole structure of claim 13, wherein the second layer is a different color than the outer-most layer, and wherein the second layer is only visible through the etching.

15. An article of footwear having a forefoot portion, a midfoot portion, and a heel portion, the article of footwear comprising:

an upper defining an internal cavity operative to receive a foot of the wearer;

a sole structure coupled to the upper, the sole structure comprising:

a ground contacting surface opposite the upper;

a midsole formed from a thermoplastic polymeric foam, the midsole having a foam sidewall that defines at least a portion of an outer perimeter of the sole structure, the foam sidewall extending upward at an angle relative to the ground contacting surface a heel counter having a heel counter sidewall that defines a portion of the outer perimeter of the article of footwear, the heel counter sidewall directly abutting the foam sidewall; and an etching extending continuously across both a portion of the foam sidewall and a portion of the heel counter sidewall.

16. The article of footwear of claim 15, wherein the etching comprises a channel having a channel depth relative to the adjoining outer perimeter of between about 2 μm and about 1000 μm.

17. The article of footwear of claim 15, wherein the sole structure further comprises:

a fluid-filled bladder having a bladder sidewall that defines a portion of the outer perimeter of the sole structure, the bladder sidewall directly abutting the foam sidewall; and wherein the etching extends continuously from the foam sidewall to the bladder sidewall and from the heel counter to the bladder element.

* * * * *